US005472408A

United States Patent [19]

Yates

[11] Patent Number: 5,472,408

[45] Date of Patent: Dec. 5, 1995

[54] BACK MASSAGE APPARATUS

[76] Inventor: Ronald D. Yates, Rte. 1 Box 48, Buncombe, Ill. 62912

[21] Appl. No.: 205,086

[22] Filed: Mar. 3, 1994

[51] Int. Cl.[6] ..... A61H 15/00

[52] U.S. Cl. ..... 601/119; 601/116; 601/117; 601/120

[58] Field of Search ..... 601/23, 24, 93, 601/94, 97, 98, 99, 102, 103, 115–119, 120–123, 127; 297/284.7

[56] References Cited

U.S. PATENT DOCUMENTS

| | | | |
|---|---|---|---|
| 1,322,720 | 11/1919 | Noble | 601/115 X |
| 2,461,102 | 2/1949 | Ackerman | 601/99 |
| 2,577,129 | 12/1951 | Johnston et al. | 601/118 |
| 3,079,914 | 3/1963 | Bush | 601/122 X |
| 3,289,673 | 12/1966 | Russo | 601/117 |
| 3,645,256 | 2/1972 | Morrison | 601/122 |
| 3,817,243 | 6/1974 | Perrine | 601/118 X |
| 4,173,972 | 11/1979 | Kodera | 601/102 |
| 4,405,128 | 9/1983 | McLaughlin et al. | 601/24 X |
| 4,411,421 | 8/1983 | Hershberger | 601/118 X |
| 4,519,605 | 5/1985 | Leland | 601/115 X |
| 4,768,779 | 9/1988 | Oehman, Jr. et al. | 272/94 |
| 4,893,808 | 1/1990 | McIntyre et al. | 272/94 |
| 5,020,518 | 6/1991 | Spears et al. | 128/52 |
| 5,116,359 | 5/1992 | Moore | 606/241 |
| 5,165,390 | 11/1992 | Fleetwood | 128/33 |

FOREIGN PATENT DOCUMENTS

| | | | |
|---|---|---|---|
| 2166351 | 5/1986 | United Kingdom | 601/117 |
| 2186489 | 8/1987 | United Kingdom | 601/121 |

*Primary Examiner*—Robert A. Hafer
*Assistant Examiner*—Brian E. Hanlon

[57] ABSTRACT

A massage apparatus which includes a support platform mounting spaced bifurcated supports, each having a respective pivot leg mounted thereto projecting from the platform, with the pivot legs pivotally mounting a U-shaped handle thereto, with the U-shaped handle having extending therefrom a support shaft in a spaced relationship relative to the handle, and the support shaft having roller cylinders mounted thereon such that upon oscillation of the handle, the roller cylinders may be directed across an individual's back for massage thereof.

3 Claims, 3 Drawing Sheets

BACK MASSAGE APPARATUS

BACKGROUND OF THE INVENTION

1. Field of the Invention

The field of invention relates to massage apparatus, and more particularly pertains to a new back massage apparatus wherein the same permits the therapeutic massage of an individual's back area.

2. Description of the Prior Art

Various exercise apparatus and massage structures have been indicated in the prior art such as the apparatus indicated in the U.S. Pat. No. 4,758,779 to an exercise structure, with U.S. Pat. No. 5,020,518 indicating a roller massage apparatus mounted within an associated seat member, and U.S. Pat. No. 5,155,390 which sets forth a further example of a back massage structure.

The instant invention attempts to overcome deficiencies of the prior art by providing for a back massage structure arranged for ease of use as well as effectiveness in construction and in this respect, the present invention substantially fulfills this need.

SUMMARY OF THE INVENTION

In view of the disadvantages inherent in the known types of back massage apparatus now present in the prior art, the present invention provides a back massage apparatus wherein the same provides for a row of roller cylinders arranged for massaging an individual's back. As such, the general purpose of the present invention, which will be descried subsequently in greater detail, is to provide a new back massage apparatus and method which has many of the advantages of the prior art listed heretofore and many novel features that result in a back massage apparatus which is not anticipated, rendered obvious, suggested, or even implied by any of the prior art, either alone or in any combination thereof.

To attain this, the present invention provides a massage apparatus includes a support platform mounting spaced bifurcated supports, each having a respective pivot leg mounted thereto projecting from the platform, with the pivot legs pivotally mounting a U-shaped handle thereto, with the U-shaped handle having extending therefrom a support shaft in a spaced relationship relative to the handle, and the support shaft having roller cylinders mounted thereon such that upon oscillation of the handle, the roller cylinders may be directed across an individual's back for massage thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new back massage apparatus and method which has many of the advantages of the prior art listed heretofore and many novel features that result in a back massage apparatus which is not anticipated, rendered obvious, suggested, or even implied by any of the prior art, either alone or in any combination thereof.

It is another object of the present invention to provide a new back massage apparatus which may be easily and efficiently manufactured and marketed.

It is a further object of the present invention to provide a new back massage apparatus which is of a durable and reliable construction.

An even further object of the present invention is to provide a new back massage apparatus which is susceptible of a low cost of manufacture with regard to both materials and labor, and which accordingly is then susceptible of low prices of sale to the consuming public, thereby making such back massage apparatus economically available to the buying public.

Still yet another object of the present invention is to provide a new back massage apparatus which provides in the apparatuses and methods of the prior art some of the advantages thereof, while simultaneously overcoming some of the disadvantages normally associated therewith.

Yet another object of the present invention is to provide a new back massage apparatus in which roller cylinders may be directed across an individual's back for massage thereof.

Even still yet another object of the present invention is to provide a new back massage apparatus which includes a support platform mounting spaced bifurcated supports, each having a respective pivot leg mounted thereto projecting from the platform, with the pivot legs pivotally mounting a U-shaped handle thereto, with the U-shaped handle having extending therefrom a support shaft in a spaced relationship relative to the handle, and the support shaft having roller cylinders mounted thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
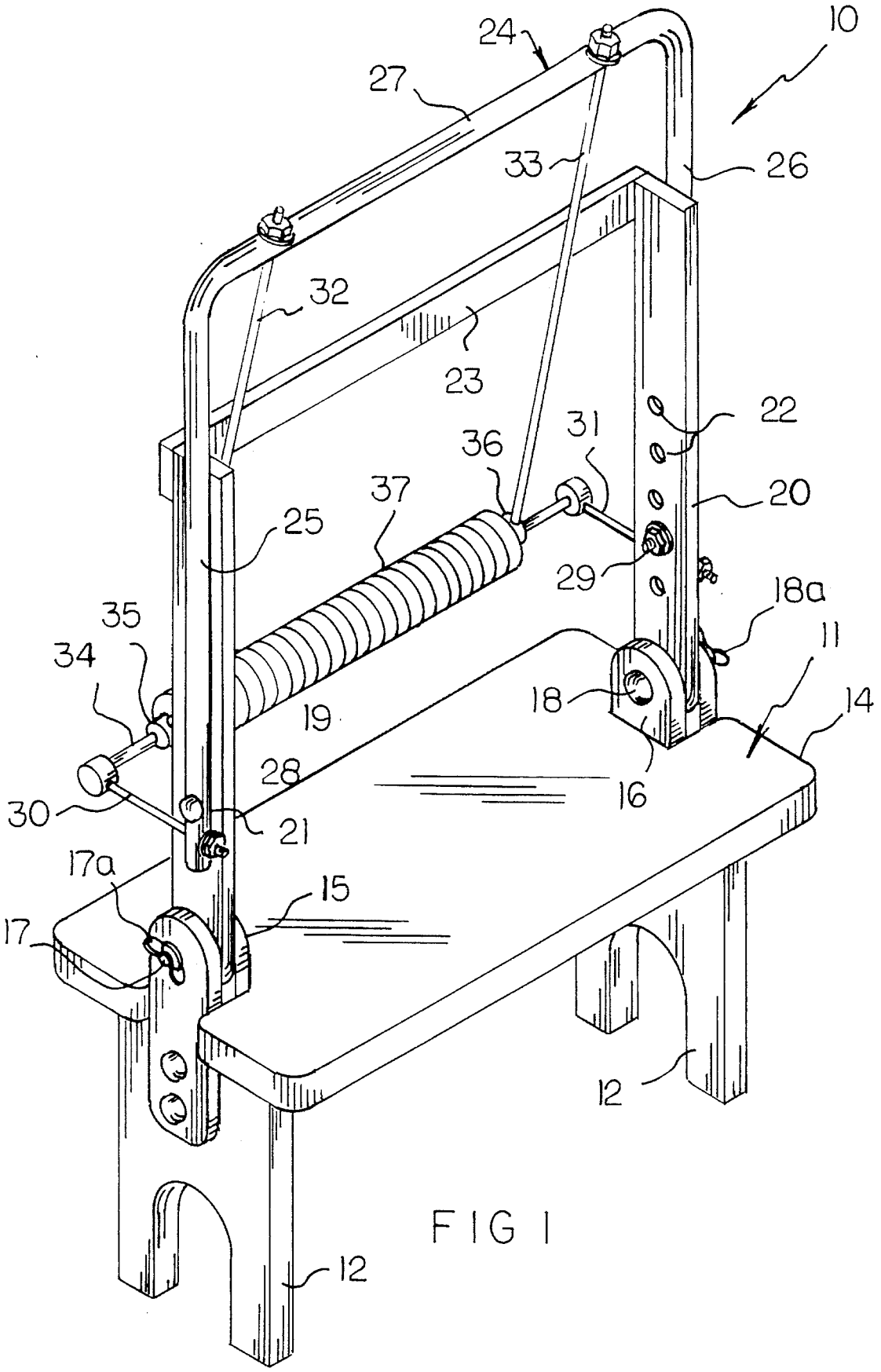
FIG. 1 is an isometric illustration of the invention.

With reference now to the drawings, and in particular to FIGS. 1–6 thereof, a new back massage apparatus embodying the principles and concepts of the present invention and generally designated by the reference numeral 10 will be described.

More specifically, the back massage apparatus 10 of the instant invention comprises a support platform 11 having platform legs 12 projecting therebelow to support the platform in a spaced relationship relative to an underlying surface. The platform 11 includes first and second ends 13 and 14 having respective first and second bifurcated supports 15 and 16 projecting above the support platform, and the first and second bifurcated supports 15 and 16 pivotally mounting respective first and second pivot legs 19 and 20 about respective first and second axles 17 and 18. The first and second axles 17 and 18 are secured by means of first and second axle fasteners 17*a* and 18*a* to the bifurcated supports 15 and 16 respectively, as best illustrated in FIG. 1.

The first pivot leg includes a row of first leg apertures 21, while the second pivot leg includes a row of second leg apertures 22. A cross brace 23 fixedly and orthogonally extends between the first and second pivot legs 19 and 20 and provides for integral construction in positioning of the first and second pivot legs relative to one another. A U-shaped handle 24 extends along the first and second pivot legs 19 and 20, including a first handle leg 25 extending along the first pivot leg, with the second handle leg 26 extending along the second handle leg, with a connecting leg 27 directed orthogonally between the first and second handle legs and spaced above the first and second pivot legs. A first leg axle 28 pivotally mounts the first handle leg 25 to one of the first leg apertures 21, while a second leg axle 29 pivotally mounts the second handle leg 26 to one of the second leg apertures 22 to provide for vertical adjusting of the massaging structure of the invention relative to the support platform 11.

First and second support rods 30 and 31 extend orthogonally from the respective first and second handle legs 25 and 26, with the first and second support rods 30 and 31 being mounted to respective first and second ends of a support shaft 34 extending orthogonally and fixedly between the first and second support rods 30 and 31. A third support rod 32 extends from the connecting leg 27 to the support shaft 34 spaced from the first support rod in adjacency thereto, while a fourth support rod 33 extends orthogonally from the connecting leg 27, parallel to the third support rod 32, to orthogonally intersect the support shaft 34 in a spaced adjacency to the second support rod 31.

Figure 3:
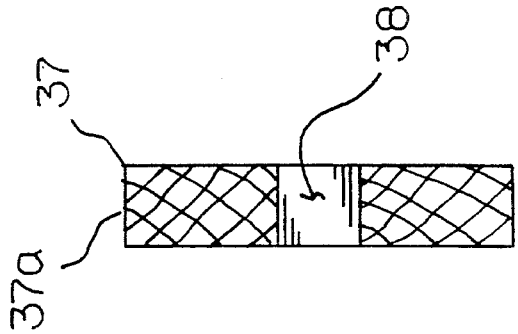
FIG. 3 is an orthographic cross-sectional illustration, taken along the lines 3—3 of FIG. 2 in the direction indicated by the arrows.
Figure 2:
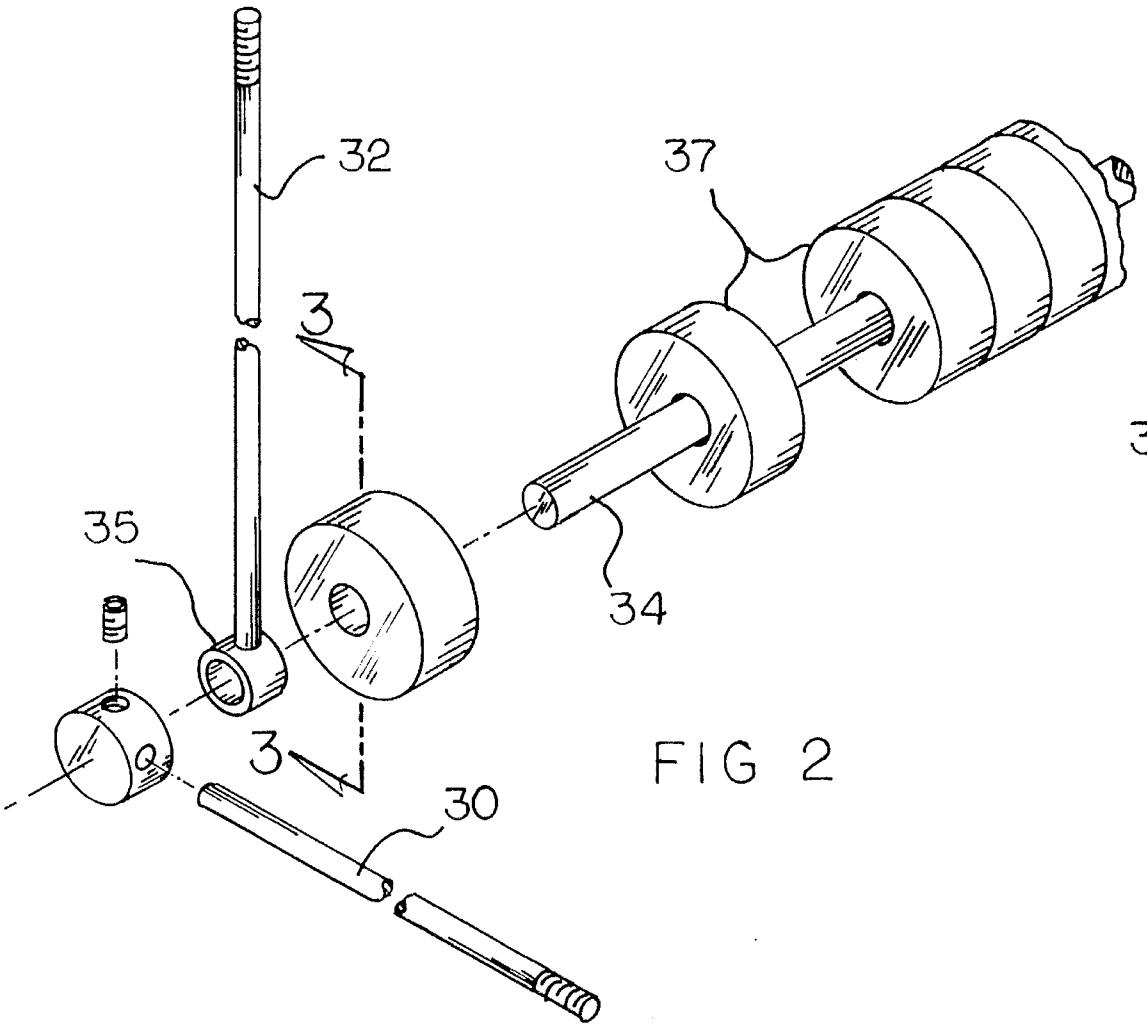
FIG. 2 is an exploded illustration of the interconnection of the first and third support rods relative to the support shaft.

As best illustrated in FIGS. 1 and 2, the third and fourth support rods 32 and 33 are mounted to respective first and second abutment hubs 35 and 36 that have extending coextensively therebetween a row of roller cylinders 37 that are rotatably mounted about a central bore 38 about the support shaft 34. FIG. 3 illustrates the roller cylinder as having a squared peripheral edge 37*a*, however, the edge of the roller cylinders may be tapered, rounded, or the like.

Figure 4:
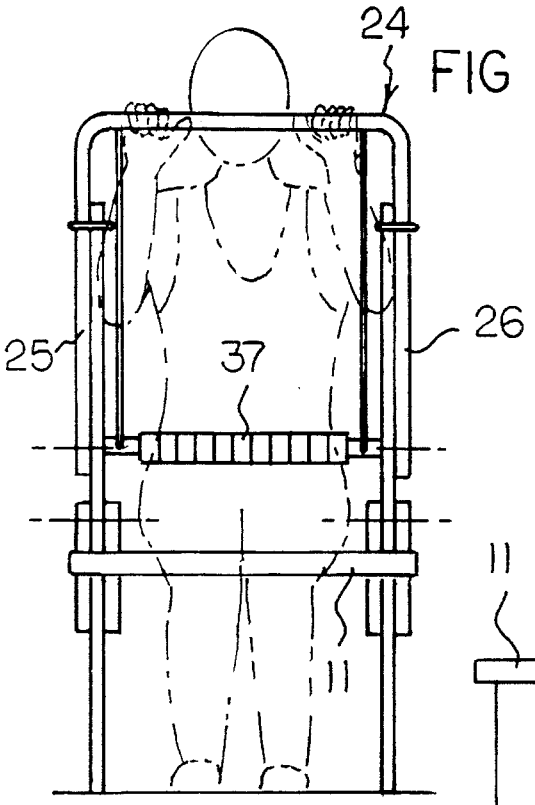
FIG. 4 is a front elevational view of the device in a first use.
Figure 5:
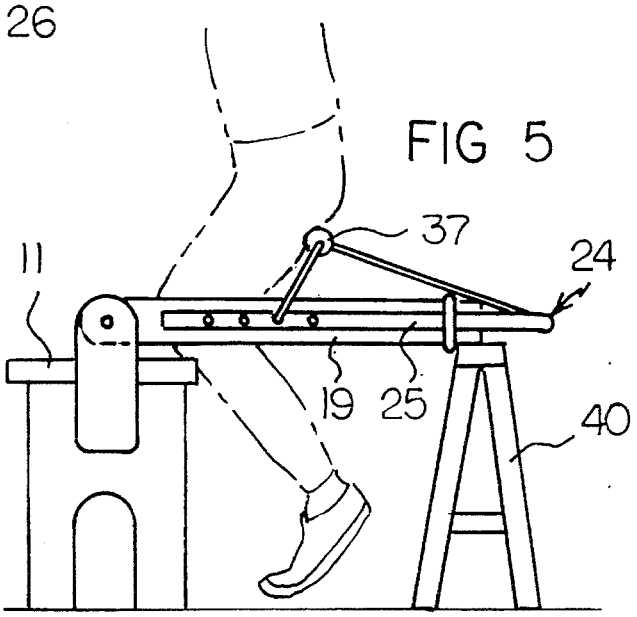
FIG. 5 is a side elevational view of the device in a second use.
Figure 6:
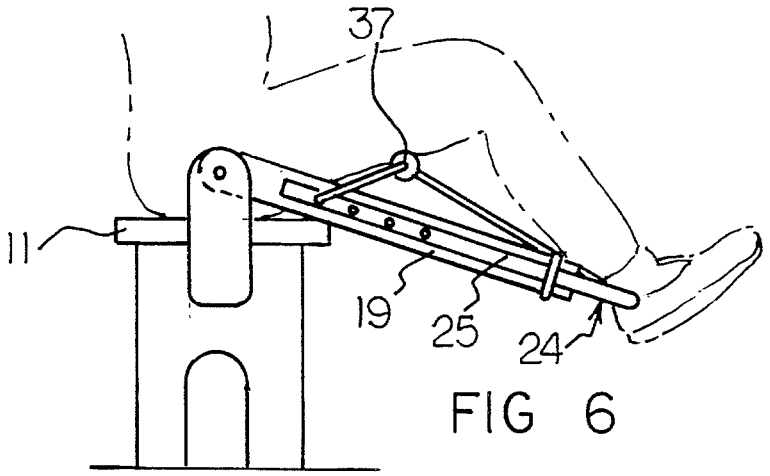
FIG. 6 is further side elevational view of the device in a third use.

The device 10 may be utilized as shown in the FIGS. 4–6. With reference to FIG. 4, the device 10 may be utilized in a first use by an individual sitting on the platform 11 with the individual's back positioned in contact with the rollers 37, whereby a pivoting movement of the U-shaped handle 24 will advance the rollers arcuately upward and over the individual's back to effect massaging thereof. Reference to FIG. 5 indicates the device in a second use wherein the U-shaped handle 24 is rested upon a sawhorse 40 or other similar support, whereby the individual may then position the individual's buttocks and lower legs against the rollers 37 such that a squatting and standing motion may be repeated to effect massage thereof. FIG. 6 illustrates the device in yet a third use wherein the first and second pivot legs 19 and 20 are pivoted against the platform 11, wherein an individual then places the individual's lower, posterior leg portions against the rollers 37 to effect massaging thereof.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A back massage apparatus comprising:

a support platform, the support platform including a first end spaced from a second end, and a platform top surface spaced from a platform bottom surface;

a first bifurcated support mounted to the first end of the platform and projecting above the top surface and a second bifurcated support mounted to the second end of the platform and projecting above the top surface;

a first pivot leg pivotally mounted to the first bifurcated support and a second pivot leg pivotally mounted to the second bifurcated support, with a first axle directed through the first pivot leg and the first bifurcated support, and a second axle directed through the second bifurcated support and the second pivot leg, and a cross brace extending orthogonally between the first pivot leg and the second pivot leg, with the first pivot leg and the second leg arranged in a parallel relationship relative to one another;

a U-shaped handle having a first handle leg pivotally mounted to the first pivot leg and extending substantially parallel and juxtaposed with the first pivot leg so that said first handle leg is capable of extending above said platform top surface, and a second handle leg pivotally mounted to the second pivot leg and extending substantially parallel and juxtaposed with the second pivot leg so that said second handle leg is capable of extending above said platform top surface, a connecting leg extending between the first handle leg and the second handle leg, a first leg axle pivotally mounting the first handle leg to the first pivot leg, and a second leg axle pivotally mounting the second handle leg to the second pivot leg;

roller means mounted to the first handle leg and the second handle leg for imparting a therapeutic massage onto a back of an individual positioned upon the platform.

2. An apparatus as set forth in claim 1, wherein the roller means includes a first support rod coupled directly to and projecting orthogonally from the first handle leg, and a second support rod coupled directly to and extending orthogonally from the second handle leg, wherein the first support rod and the second support rod are arranged in a coextensive parallel relationship relative to one another;

a support shaft having a support shaft first end and a support shaft second end, with the support shaft first end being fixedly and orthogonally mounted to the first support rod, and the support shaft second end being fixedly and orthogonally mounted to the second support rod;

a third support rod coupled directly to and extending orthogonally from the connecting leg, and a fourth support rod coupled directly to and extending orthogonally from the connecting leg, with the third support rod and the fourth support rod arranged in a parallel coextensive relationship, with the third support rod terminating in a first abutment hub receiving the support shaft therethrough, and the fourth support rod terminating in a second abutment hub receiving the support shaft therethrough, wherein the first abutment hub and the second abutment hub are arranged in a spaced relationship; and, a row of cylinder members extending between the first abutment hub and the second abutment hub about the support shaft.

3. An apparatus as set forth in claim 2, wherein the first pivot leg includes a row of first leg apertures, and the second pivot leg includes a row of second leg apertures, with said first leg axle pivotally mounting the first handle leg to one of the first leg apertures, and said second leg axle pivotally mounting the second handle leg to one of the second leg apertures to provide for vertical adjusting of the U-shaped handle relative to the support platform.

* * * * *